US006708539B1

(12) United States Patent
Widen

(10) Patent No.: US 6,708,539 B1
(45) Date of Patent: Mar. 23, 2004

(54) LOCK WITH REMOVABLE CORE

(75) Inventor: Bo Widen, Torshälla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 09/869,968

(22) PCT Filed: Jan. 21, 2000

(86) PCT No.: PCT/SE00/00129

§ 371 (c)(1),
(2), (4) Date: Oct. 3, 2001

(87) PCT Pub. No.: WO00/43619

PCT Pub. Date: Jul. 27, 2000

(30) Foreign Application Priority Data

Jan. 22, 1999 (SE) ..... 9900192

(51) Int. Cl.[7] ..... E05B 9/04
(52) U.S. Cl. ..... 70/371; 70/369; 70/373
(58) Field of Search ..... 70/369, 371, 367, 70/368, 370, 373, 337, 340

(56) References Cited

U.S. PATENT DOCUMENTS

| | | | | |
|---|---|---|---|---|
| 2,059,678 | A | 11/1936 | Briggs | |
| 3,404,549 | A | 10/1968 | Best | |
| 3,667,264 | A | 6/1972 | Surko, Jr. et al. | 70/369 |
| 4,328,690 | A | 5/1982 | Oliver | 70/369 |
| 4,424,693 | A | 1/1984 | Best et al. | 70/369 |
| 4,444,034 | A | 4/1984 | Best et al. | 70/369 |
| 5,678,438 | A | 10/1997 | Kolkman et al. | 70/370 |
| 5,813,260 | A | 9/1998 | Widen | 70/369 |

FOREIGN PATENT DOCUMENTS

| | | |
|---|---|---|
| DE | A2723887 | 12/1978 |
| EP | A2 0473288 | 3/1992 |
| GB | A2216944 | 10/1989 |

*Primary Examiner*—Lloyd A. Gall
(74) *Attorney, Agent, or Firm*—Birch, Stewart, Kolasch & Birch, LLP

(57) ABSTRACT

A removable core cylinder having a casing with a cavity, a lock core insertable into the cavity, a cylindrical, rotatable key plug located in a bore in the core, and a retainer member, which is transversely movable in the lock core between a first, locking position and a second, releasing position. The casing has an inwardly protruding locking projection which engages with an axially limited recess in the retainer member when the latter is located in the first, locking position.

22 Claims, 8 Drawing Sheets

10
12
11
50
20
60
99
52
25
26
74
71
70
72
73
28
24
27
23
21
40
48
42
45
51
49
41
68
61

A-A

B-B

C-C

LOCK WITH REMOVABLE CORE

This application is the national phase under 35 U.S.C. §371 of PCT International Application No. PCT/SE00/00129 which has an International filing date of Jan. 21, 2000, which designated the United States of America and was published in English.

BACKGROUND OF THE INVENTION

1. Field of the Invention

The present invention relates to a cylinder lock with a removable core of the kind comprising:

a cylinder lock casing having interior wall surfaces defining an axially extending cavity with an insertion opening, a removable cylinder lock core which is axially insertable into said cavity through said insertion opening, said lock core having an upper, substantially massive part with a row of holes for accommodating locking tumblers, and a lower part defining a cylindrical bore extending axially therethrough, a cylindrical, rotatable key plug located in said cylindrical bore and having a longitudinal key slot for receiving a key co-operating with said locking tumblers, and a retainer member being transversely movable in a chamber in the upper part of said lock core between a first position, in which it positively locks said lock core in its axially inserted position, and a second position, in which said lock core may be axially inserted into or retracted from said casing, said retainer member having a locking surface facing towards said insertion opening and engaging with said casing when said retainer member is in said first position.

2. Description of the Background Art

Such a lock with a removable core is previously known, e.g., from U.S. Pat. No. 4,328,690 (Medeco) and WO 96/36782 (Winloc). In the prior art locks, the locking surface on the retainer member is formed on an outwardly projecting locking lug, which engages with a recessed portion of the casing so as to retain the lock core in its inserted position. The locking lug can be moved to a second, releasing position where it is instead accommodated in a recess in the massive upper part of the lock core. Then, the whole lock core with the key plug may be retracted axially from the lock casing by a sliding movement. The lock core has an outer contour corresponding to the cross-sectional shape of the cavity of the casing, normally in the general shape of an "8", with a slight play therebetween to permit the relative sliding movement.

With such a system, it is of course possible to replace a lock core of a first kind by another lock core of a second kind, so long as the cross-sectional dimensions of the lock cores are the same and the locking lugs correspond to each other. However, for economic and security reasons, it is in the interest of any lock manufacturer and any authorized user of the system that the lock cores cannot be replaced by other kinds of lock cores, e.g., made by another manufacturer.

Furthermore, a locking lug projecting into a recess in the wall of the casing may be destroyed by a machining operation, e.g., by drilling axially into the casing wall from the front side of the lock in the region where the recess and the engaging locking lug are located, normally in the vicinity of the mid-portion of the lock core in case it is formed like an "8".

SUMMARY AND OBJECTS OF THE INVENTION

Against this background, the main object of the present invention is to provide a novel embodiment of the locking means holding the lock core in its inserted position in the casing so as to increase the security of the lock.

Other objects are to provide high security against unauthorized retraction or replacement of the lock core and to enable rational but controlled manufacture of the lock casings and the associated lock cores and key plugs.

The stated main object is achieved in that the lock casing comprises a locking projection, which protrudes from one of the interior wall surfaces so as to project inwardly from said inner cross sectional contour and to engage with the locking surface of the retainer member, when the latter is in the first position, said lock core and said retainer member being adapted to form a longitudinal recess located adjacent to said chamber in the region of said outer cross sectional contour and being dimensioned to accommodate said locking projection when said retainer member is located in said second position and said lock core is being inserted into or retracted from said casing.

It is not a trivial matter to arrange such inwardly projecting locking projections, since a locking projection which protrudes inwards from the cavity wall will normally interfere with the contour of the lock core, which matches the inner contour of the casing. However, it is then possible to let the projection fit freely into the above-mentioned longitudinal recess of the lock core.

Preferably, the longitudinal recess of the lock core is a rectilinear slot, e.g., extending from one end thereof, and the retainer member is preferably dimensioned to leave said rectilinear slot at least partially free when being situated in said second position, so as to permit axial displacement of said locking projection along said rectilinear slot during insertion or retraction of the lock core, and to effectively block access to said rectilinear slot when being situated in said first position, so as to positively lock said retainer member and said lock core in their axially inserted positions in said cavity of said casing.

The present invention also concerns a removable lock core as such and including a retainer member, the lock core and the retainer member being adapted to form a longitudinal recess dimensioned to accommodate, when said retainer member is located in said second position, a locking projection protruding from an interior wall of an associated casing radially inwards from said inner cross sectional contour of the casing.

The retainer member may have a limited circumferential extension, which is substantially supplemental to an axially continuous wall portion defining a part of the cylindrical bore, or it may be circumferentially closed so as to form a circular-cylindrical sleeve element, in which case there is an axially extending slot portion in said sleeve element being aligned to the rectilinear slot when the retainer member is located in said second position, an axially limited recess being dimensioned to accommodate the locking projection.

The locking surface on the retainer member may be formed on an end surface of a longitudinal edge portion thereof, or on a transversely projecting, axially limited tongue, or on a wall portion defining an axially limited recess.

In any case, the removable core can only be replaced by a core of the same kind, i.e. being designed to accommodate the inwardly projecting locking projection while being inserted into the casing. Furthermore, the locking projection is protected by the core itself when the latter is located in its fully inserted position.

The locking projection should be long enough to engage with the locking surface on the retainer member. However, the radial extension is preferably limited so as not to interfere directly with the rotatable key plug. Most preferably, the radial extension of the locking projection is such as to reach into close vicinity of the wall surface of said cylindrical bore.

In a further developed embodiment according to the invention, the casing has, in addition to the locking projection, an axially limited recessed portion in one of said interior wall surfaces, and the locking means of the retainer member comprises, in addition to an axially limited recess, a locking lug fitting into said recessed portion of the casing when the retainer member is located in said first position. Such a locking lug may be located in close vicinity to said axially limited recess.

These and other advantageous features are stated in the dependant claims and will be apparent from the detailed description below.

BRIEF DESCRIPTION OF THE DRAWINGS

The invention will now be explained more fully with reference to the accompanying drawings which illustrate some preferred embodiments.

DETAILED DESCRIPTION OF THE PREFERRED EMBODIMENTS

Figures 1A, 1B, 2:
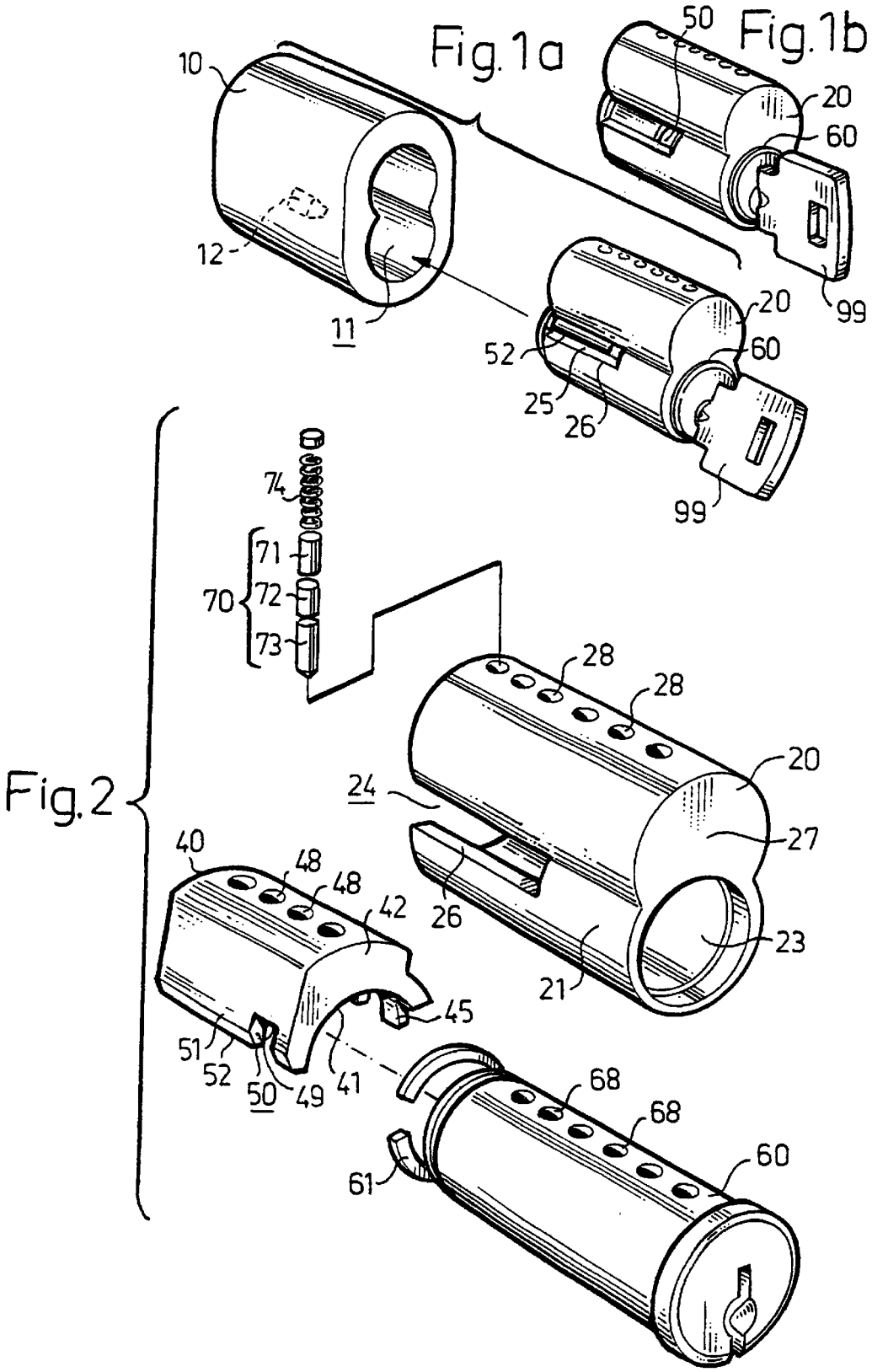
FIG. 1*a* shows in a perspective view a cylinder lock casing and a removable cylinder lock core to be inserted into the casing.
FIG. 1*b* shows the lock core of FIG. 1*a*, wherein the key plug is located in a different rotational position.
FIG. 2 illustrates, likewise in a perspective view, the basic parts of the removable cylinder lock core shown in FIG. 1*a*, these parts being separated from one another for increased clarity.
Figure 3:
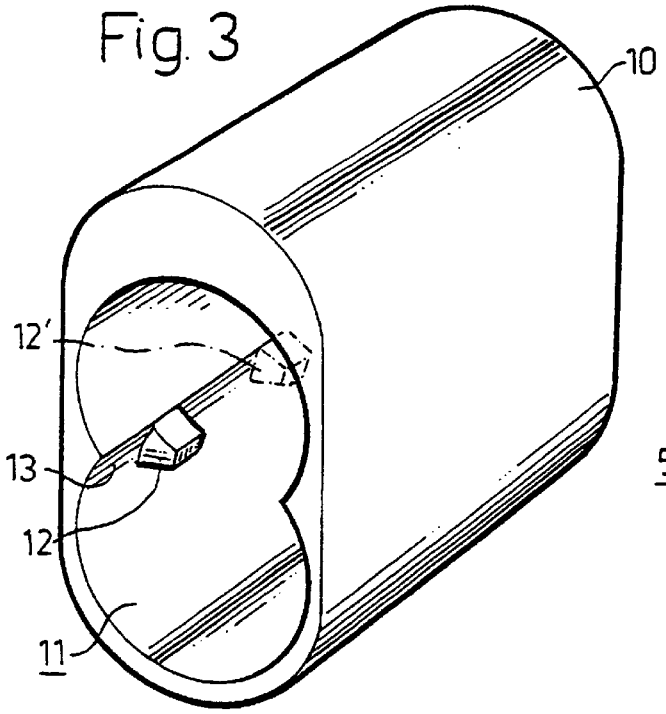
FIG. 3 is a perspective view of the lock casing of FIG. 1*a;*

The first embodiment of the lock according to the invention, shown in FIGS. 1*a* through 12, comprises a conventional cylinder lock casing 10 having an axially extending cavity 11, which has a cross-sectional shape essentially like the digit "8" and which is dimensioned for receiving a removable lock core 20 with a rotatable key plug 60 and a key 99. The casing 10 is intended to be permanently mounted in a door (not shown) or some other object to be locked in relation to a frame or some other stationary structure. Alternatively, the casing 10 may constitute a padlock or some other locking device.

The removable cylinder lock core 20 is axially insertable through an insertion opening 13 into the cavity 11 of the casing 10 and is retained in the casing by means of a retainer member 40, which cooperates with the casing 10, the lock core 20 and the key plug 60. The key plug 60 cooperates, at its rear end by means of an axially projecting member (not shown), with a secondary locking mechanism of any kind.

In the preferred embodiment, the outer cross-sectional contour of the lock core 20 corresponds exactly to the inner cross-sectional contour of the casing 10, with a slight play therebetween. Accordingly, the lock core 20 fits slidably in the cavity 11 and is held firmly in its inserted position during normal use of the lock. To this end, there are mutually cooperating locking means at the inside wall of the cavity 11 and at an edge portion of the retainer 40. According to the invention, the locking means at the casing 10 is constituted by at least one locking projection 12, which protrudes inwardly from the interior wall 13 defining the cavity 11. In the preferred embodiment, the projection is located slightly underneath the transition between the upper and lower parts of the cavity, as appears from FIG. 3.

The corresponding locking means on the retainer member 40 is constituted by a locking surface 49, which faces the insertion opening 13 and is adapted to engage with the locking projection 12, when the lock core 20 is inserted fully into the cavity 11 and the retainer member 40 is located in a locking position. In the preferred embodiment, shown in FIGS. 2 and 4*a*, the locking surface 49 forms a part of a recess 50 located in a longitudinal edge portion 51 of the retainer member.

Figure 4A:
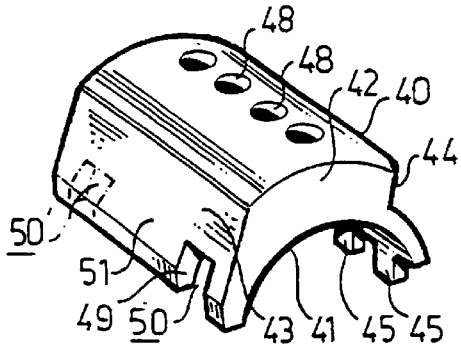
FIG. 4*a* is a perspective view of a retainer member also illustrated in FIG. 2.
Figure 4B:
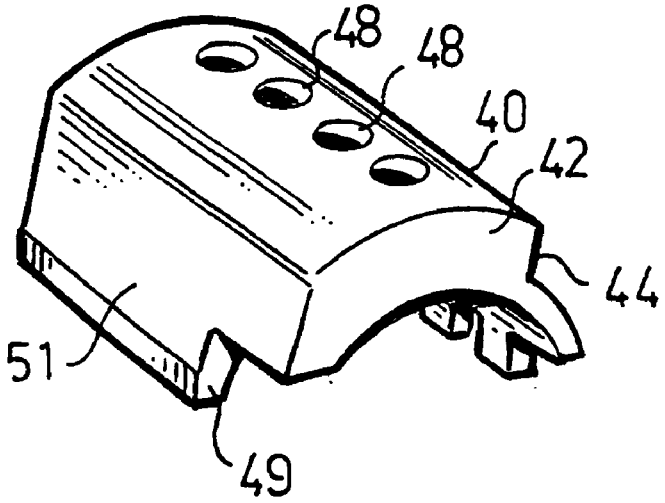
FIGS. 4*b* and 4*c* illustrate modified embodiments of the retainer member of FIG. 4*a;*
Figure 4C:
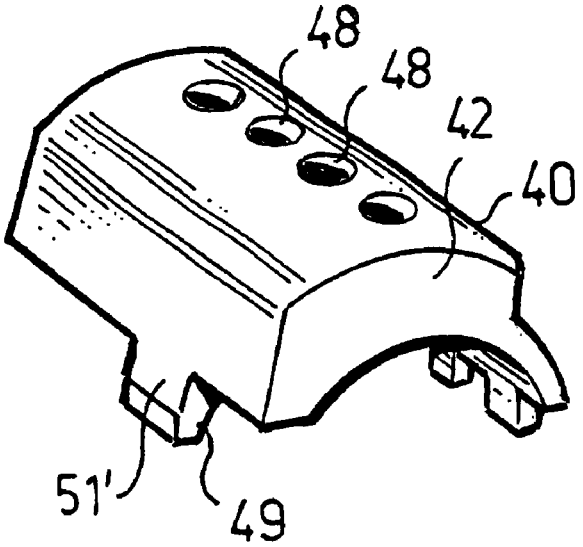
Figure 7:
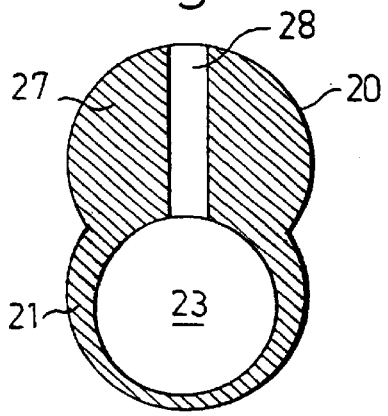
FIG. 7 is a cross-sectional view taken along line VII in FIG. 6.
Figure 8:
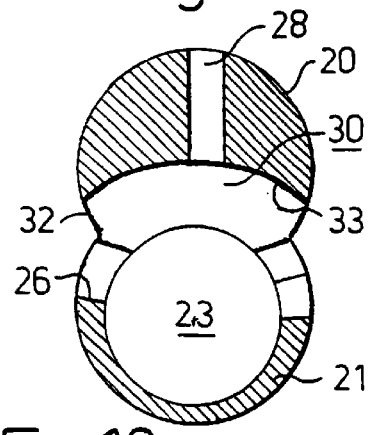
FIG. 8 is a cross-sectional view taken along line VIII in FIG. 6.

The locking surface 49 may alternatively form an end surface of an edge portion 51, which is somewhat shorter in the axial direction, as shown in FIG. 4*b*, or an end surface of transversely projecting, axially limited tongue 51', as illustrated in FIG. 4*c*.

In order to enable insertion of the lock core 20, in spite of the existence of the locking projection 12, which protrudes into the interior region of the cavity 11 normally occupied by the lock core 20, the lock core 20 has a longitudinal slot 24 in a lower part 21, said lower part 21 defining an interior cylindrical bore 23. The longitudinal slot 24 extends rectilinearly in the axial direction. The slot is dimensioned to accommodate the edge portion 51 (or the tongue 51') of the retainer member 40, when the latter is moved to its locking position, and to freely accommodate the locking projection 12, when the retainer member is moved to its releasing position and the lock core 20, together with the retainer member 40 and the key plug 60, is being inserted axially into the casing 10. Then, there is a sufficient circumferential gap 25 (FIG. 1*a*) between the lower edge 26 of the slot 24 and the adjacent edge 52 (FIG. 2) of the retainer member 40.

On the other hand, when the lock core 20 is inserted fully into the casing 10, and the retainer member 40 is moved transversally, by a rotational movement in the preferred embodiment, into its locking position, as shown in FIG. 1*b*, the locking surface 49 will engage with the locking projection 12 and hold the assembled parts in fixed positions relative to each other. Also, in this locking position, the locking projection 12 is effectively protected by the lock core itself.

As appears most clearly from FIG. 2, the lock core 20 comprises an upper, massive part 27 and the above-mentioned lower part 21. In the central vertical plane of the upper part 27, there is a row of six holes 28 for accommodating upper portions 71 of locking tumblers 70 (including upper portions 71, mid portions 72 and lower portions 73), which are biased in a conventional manner by associated helical springs 74. The rotatable key plug 60 has a corresponding row of holes 68 which are in registry with the holes 28 in a locking condition. Likewise, there are four corresponding holes 48 in the retainer member for holding the latter in a locking position (as in FIG. 1*a*) by means of the upper tumbler portions 71. Upon assembly of the various parts of the lock, the key plug 60 will be held axially in place relative to the lock core 20 by means of a locking ring 61.

In the preferred embodiment, the retainer member 40 (see FIGS. 2, 4 and 9–12) has an axial length of about ⅔ of the lock core 20 and a circumferential extension of somewhat less than 180°. The lower surface 41 of the member 40 is cylindrical with the same curvature as the cylindrical bore 23 of the lock core 20, so that the bore 23 and the retainer member 40 together form a substantially complete circular-cylindrical housing for the rotatable key plug 60.

The retainer member 40 is rotatable to a limited extent about the central, longitudinal axis of the bore 23 between two end positions, viz. a first position (FIGS. 1*b*, 10, 11 and 12), in which it positively locks the lock core 20 in its axially inserted position, by mutual engagement between the locking projection 12 of the casing 10 and the locking surface 49 at the edge portion 51 of the retainer member 40, and a second position (FIGS. 1*a* and 9), in which the lock core 20 can be inserted or retracted, by a sliding movement of the locking projection 12 along the gap 25 mentioned above.

The retainer member 40 is basically formed as a part-cylindrical shell or a base portion with an upper, central portion 42 being radially extended into a greater, total thickness and being accommodated in a chamber 30 cut out in the upper, massive portion 27 of the lock core 20. The chamber 30 is defined by an upper slightly curved wall 33, corresponding essentially to the curvature of the upper surface of the central portion 42 of the retainer member.

Figure 5:
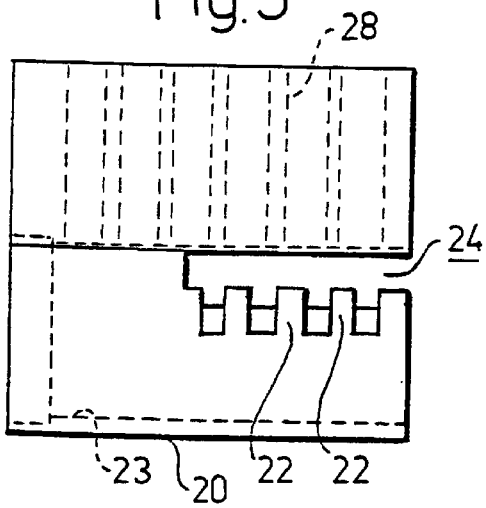
FIG. 5 is a side view of the lock core also illustrated in FIGS. 1*a* and 2.
Figure 6:
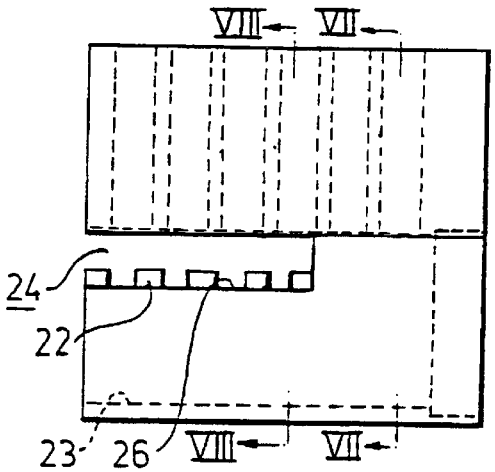
FIG. 6 shows the lock core from the other side.

The cylindrical curvature of the curved wall 33 (and the upper surface of the retainer member 40) has a central axis coinciding with the axis of the cylindrical bore 23, whereby the retainer member 40, in particular the lower surface 41 thereof, will be supplementary to the lower part 21 of the core 20, irrespective of the transversal or rotary position of the retainer member 40. The above mentioned first and second end positions are defined by the abutment of the longitudinal edge 52 against the lower edge 26 of the slot 24 (FIGS. 6 and 10) and the abutment of the opposite edge portion of the retainer member against the associated edge portion of the slot 24 (FIGS. 5 and 9).

As appears from FIGS. 4*a*, 4*b*, 4*c*, the cross-section of the retainer member 40 is substantially the same along the length thereof, except for the axially limited recess 50 or tongue 51', the holes 48 and a number of downwardly directed fingers 45 fitting between upstanding teeth 22 at the lower part 21 of the lock core 20, adjacent to the slot 24. The fingers 45 and the teeth 22 will secure a substantially continuous cylindrical bearing surface for the key plug and the tumbler portions 72, 73.

If desired, the lock can be provided with two (or more) locking projections 12,12' (see FIG. 3) at the inside of the casing 10 and corresponding locking surfaces at axially limited recesses 50, 50' at the retainer member 40.

Figure 9:
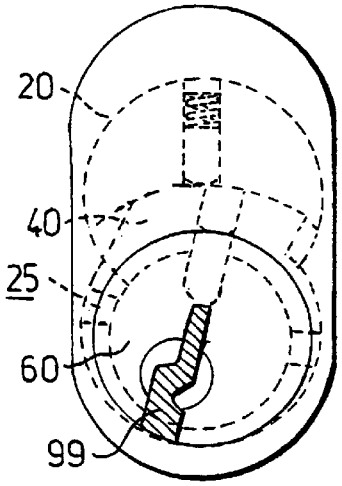
FIGS. 9–10 and 11–12 are end views of the lock core, illustrating the movement of the retainer member from its second, releasing position into its first locking position, and the normal operation of the lock, respectively.
Figure 10:
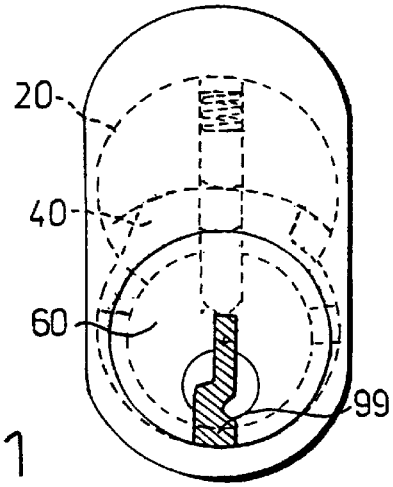

The operation of the lock is illustrated in FIGS. 9–12. In FIG. 9 (see also FIG. 1), a control key 99 is inserted into the key slot of the key plug 60 and is turned around to the right, whereby the edge portion 51 of the retainer member is brought away from the edge 26 of the slot 24 so as to leave a longitudinal gap 25, which makes it possible to insert or retract the lock core 20 in relation to the casing 10 while letting the locking projection 12 slide therealong. When the key 99 is turned to an upright position, as shown in FIG. 10 and FIG. 1*a*, the retainer member 40, the lock core 20 and the key plug 60 are all effectively locked together by means of the locking projection 12 and the locking surface 49.

Figure 11:
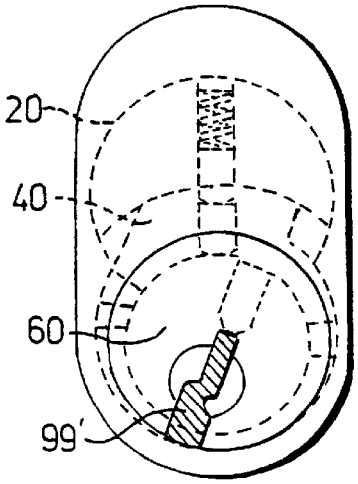
Figure 12:
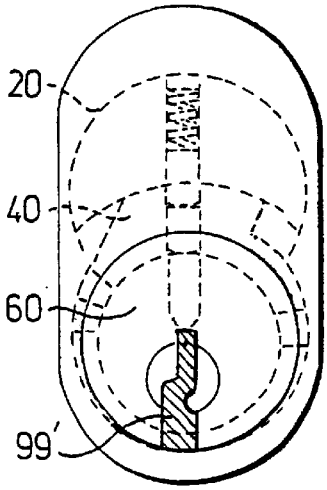
Figure 13:
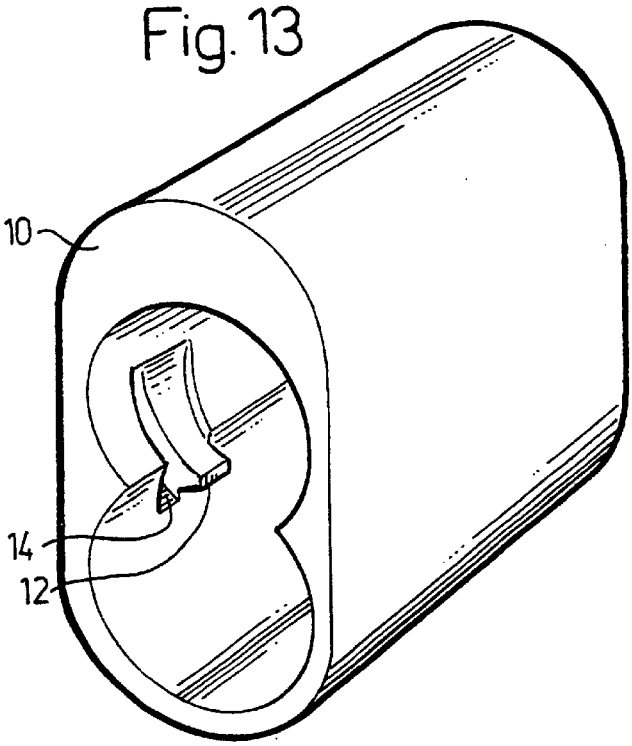
FIGS. 13–16 are views corresponding to FIGS. 3, 4 and 2 illustrating some modified embodiments.

Now, the lock can be used in the normal way by using an operating key 99', as illustrated in FIGS. 11 and 12.

The locking projection 12 should have a limited extension radially inwards so as not to interfere with the rotatable key plug 60. Preferably, the length of the locking projection 12 is substantially the same as the wall thickness (or slightly less) of the lower part 21 of the lock core 20.

FIGS. 13 through 16 illustrate some modified embodiments of the lock according to the invention. As appears from FIG. 13, it is possible to provide the lock casing 10 with an axially limited recessed portion 14 in addition to the locking projection 12, e.g., in close vicinity to the latter. As in the embodiment described above, the locking projection 12 engages with a locking surface 49 at an axially limited recess 50 in the retainer member 40, whereas the recessed portion 14 engages with a first locking lug 46 formed adjacent to the edge portion 51 of the retainer member 40.

Figure 14:
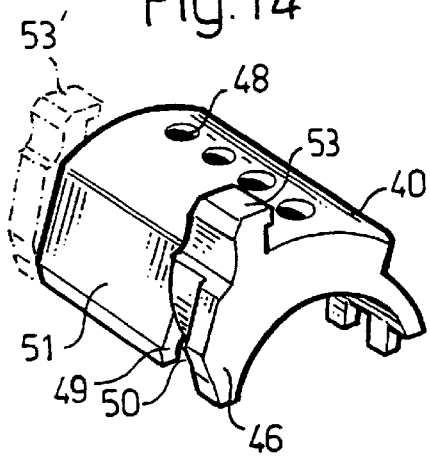
Figure 15:
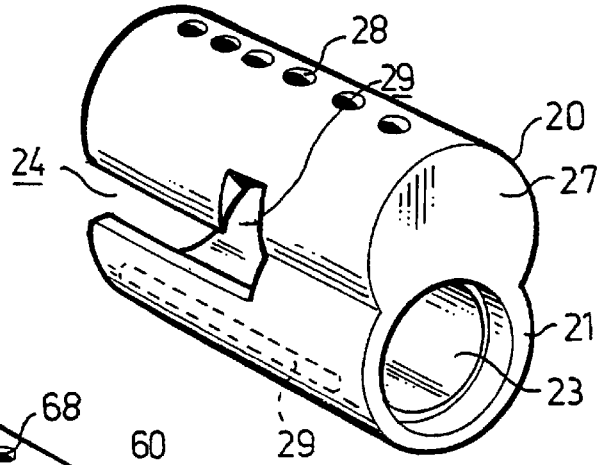

Additionally, the retainer member 40 may be provided with a second locking lug in the form of a wing 53, as described in the above-mentioned document WO 96/36782 (Winloc), which fits into a recess or cut out portion 29 adjoining the slot 24 at 30 the inner end of the latter, i.e. approximately at the axial mid portion of lock core 20 (FIG. 15). The wing 53 is partially accommodated in the recessed portion 14 when the retainer member 40 is located in its locking position. As an alternative, or as a supplement, a similar radially outwardly 35 projecting locking wing 53' may be disposed at the rear end of the retainer member 40 (FIG. 14).

Figure 16:
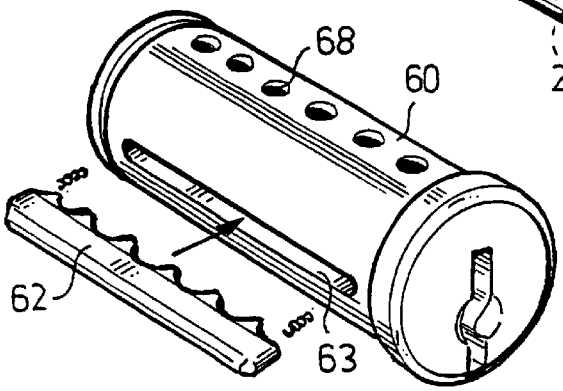
Figure 17:
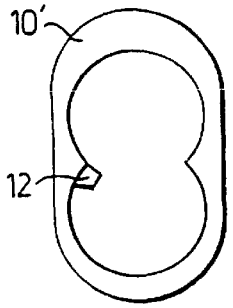
FIGS. 17–21 are various views illustrating a second embodiment of the lock according to the invention, FIG. 20 being a sectional view taken along the line 20—20 in FIG. 18 and FIG. 21 being a sectional view taken along the line 21—21 in FIG. 19.
Figure 18:
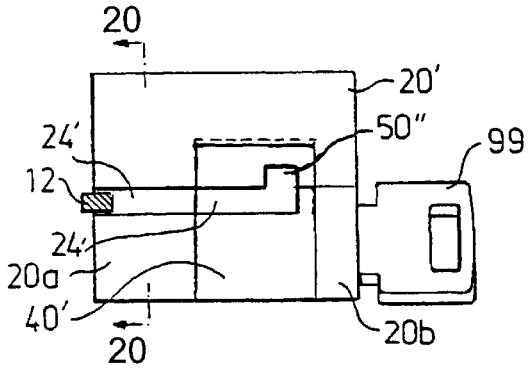

Moreover, as likewise described in the abovementioned document, the lock may be provided with a side-bar 62, which is movable in a groove 63 in the cylindrical outer surface of the key plug 60 and cooperates with side tumblers (not shown) arranged in the key plug 60. When located in a locking position, it projects into a longitudinal recess 29 adjoining the cylindrical bore 23 (FIGS. 15 and 16).

A second embodiment, similar to the lock described in the above-mentioned U.S. Pat. No. 4,328,690, is illustrated in FIGS. 17 through 21. The casing 10' is the same as in the first embodiment (FIGS. 1*a* and 3), i.e. with a locking projection 12. However, the lock core 20' is somewhat different in that it includes two axially separated lower parts 20*a*, 20*b*, between which the retainer member 30', with a lower portion formed as a circular-cylindrical sleeve, is rotatably journalled. The rear lower part 20*a* of the lock core 20' has a rectilinear slot 24 and the retainer member 40' has a corresponding slot portion 24' aligned with the slot 24 when the retainer member is located in its releasing position (FIGS. 18 and 20, corresponding to the position shown in FIG. 9 in the first embodiment) upon turning the control key to the right. In this position, the lock core 20' can be inserted into or retracted from the casing 10 while the locking projection 12 slides along the slot 24 and the aligned slot portion 24'.

Figure 19:
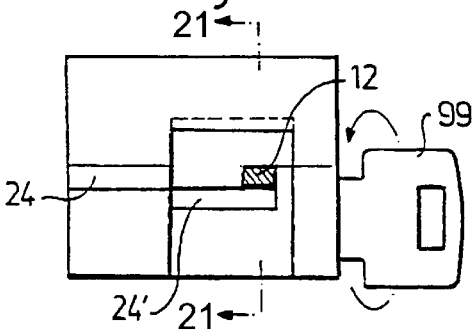
Figure 20:
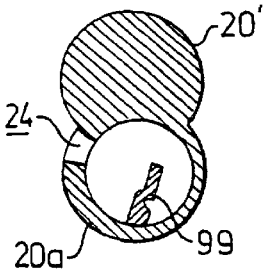
Figure 21:
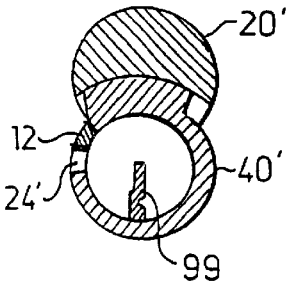

When the control key is turned to the left, i.e. into the position shown in FIG. 19, the slot portion 24' is moved into a position being offset from the rectilinear slot 24, whereas an axially limited recess 50", with a locking surface, captures the locking projection 12 (like a bayonet-type locking groove), so that the lock core 20', the retainer member 40' and the key plug (not shown) are effectively locked in the inserted position inside the lock casing 10'.

Figure 22:
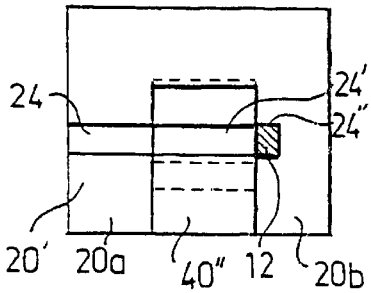
FIG. 22 is a view corresponding to FIG. 19, illustrating a modified embodiment.
Figure 23:
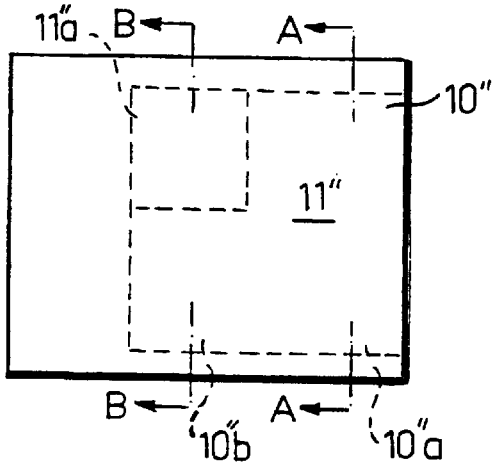
FIGS. 23–27 illustrate another embodiment of the lock casing and the associated lock core.

As an alternative, see FIG. 22, there may be an aligned slot portion 24" also in the front lower part 20*b*, having a length slightly exceeding the longitudinal dimension of the locking projection 12. Upon inserting the lock core 20' axially into the casing 10', the locking projection 12 will be located in the slot portion 24" (as illustrated). Then the retainer member 40' is rotated into its locking position where the slot portion 24' (shown by dashed lines) is offset from the slot portions 24, 24" of the rear and front lower parts 20*a*, 20*b* of the lock core 20'.

Of course, the slot portions 24, 24', 24" shown in FIGS. 17–22 may have the form of a groove with a bottom surface rather than a through-going slot, provided that the locking projection is shorter than the depth of the groove.

Figure 24:
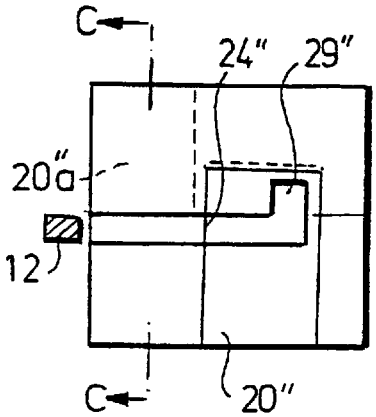
Figure 25:
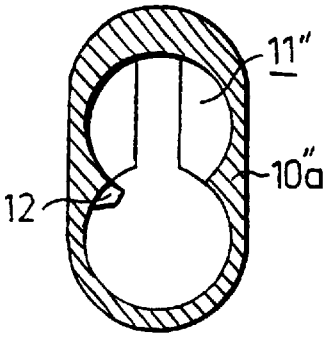
Figure 26:
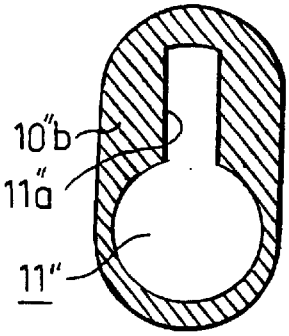
Figure 27:
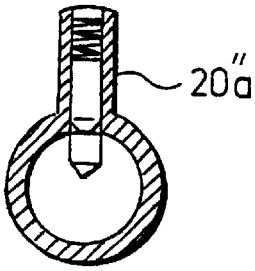
Figure 28:
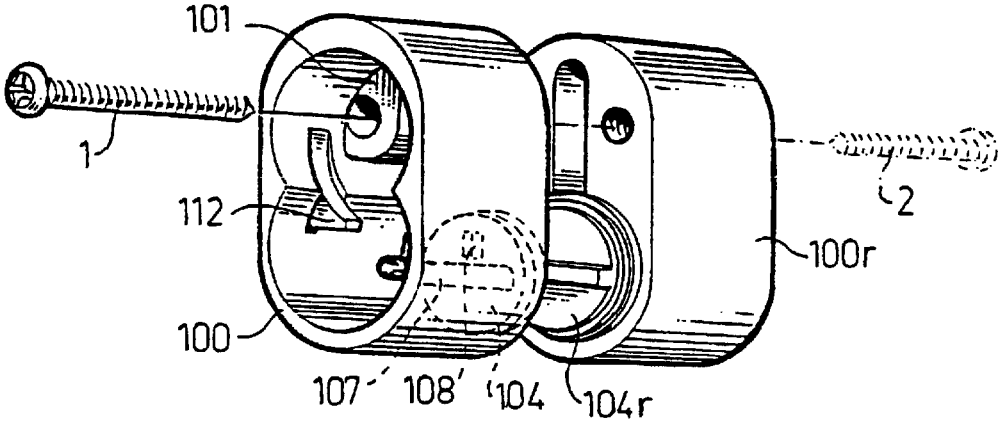
FIGS. 28–31 illustrate a fourth embodiment included in a door lock assembly.
Figure 29:
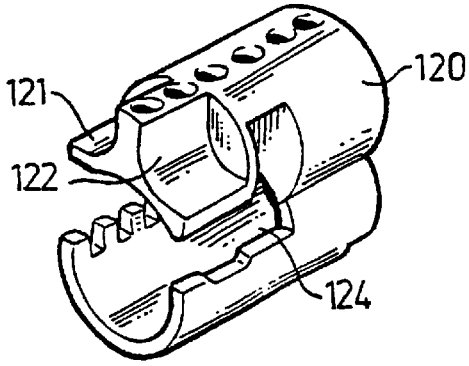
Figure 30:
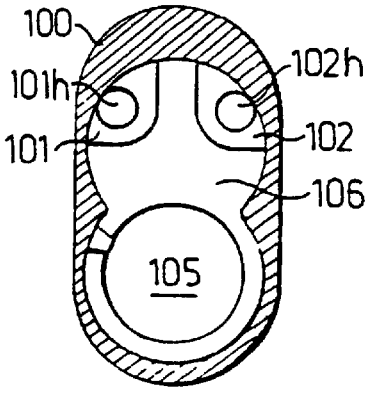
Figure 31:
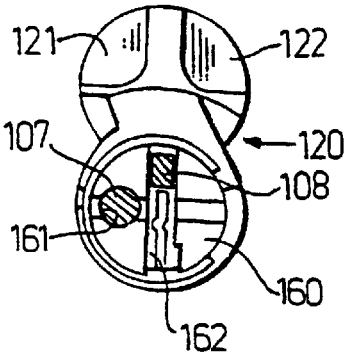

A third embodiment is shown in FIGS. 23 through 27. The front part 10"*a* of the lock casing 10" is just like the embodiment of FIG. 1*a*, with a cavity 11" having a cross-sectional contour like an "8" and a locking projection 12 protruding inwards as shown in FIG. 25, whereas the rear part 10"*b* of the lock casing 10" has a different, more narrow contour with a rectangular upper part 11"*a* (FIG. 26). The latter accommodates a corresponding rectangular upper portion 20'*a* of the rear part of the lock core 20", see also FIGS. 24 and 27.

Thus, the inner contour of the casing 10" and the outer contour of the lock core 20" vary in the longitudinal direction, but these contours are supplementary to each other along the whole length of the lock. In this embodiment, the retainer member (not shown) may be formed substantially like the retainer member shown in FIG. 4*a*, although provided with an upper wing (similar to the wing 53 in FIG. 14) fitting into the cut-out portion or recess 29" of the lock core 20" (FIG. 24).

In a fourth embodiment, the lock is a part of a door lock assembly as shown in FIGS. 28–31, including a rear casing 100*r* to be mounted at the inside of a door (not shown), and a front casing 100 to be mounted at the front side of the door. A lock core 120 (see FIGS. 29 and 31) is similar to the core 20 of FIG. 2 but has two concavely curved recesses 121, 122 dimensioned to receive two radial lugs 101, 102 at the rear end portion of the casing 100 when being inserted into the casing 100. As appears from FIG. 28, screws 1, 2 are inserted through holes 101*h*, 102*h* and are used to secure the casings 100, 100*r* to the door.

At the rear end of the casing 100, a rotatable locking member 104 is rotatably journalled in a circular opening 105 in the rear wall 106 of the casing. The rotatable member 104 has an axial, relatively long rod 107 and an axial, relatively short rod 108 extending into the internal cavity of the casing and into an axial hole 161 and a diametrical groove 162, respectively, at the end portion of the key plug 160 of the lock core (only shown in FIG. 31). In this way the rotary movement of the key plug is transferred to the locking member 104.

In order to make sure that only lock cores 120 of the same kind are insertable into the casing 100, the axial hole 161 is very wide, about 4 to 5 mm, (the key plug has a diameter of 12 to 14 mm, preferably about 13 mm), and the smallest wall thickness between the circumferential surface of the key plug 160 and the axial hole 161 is about 0.5 mm. The diameter or width of the axial rod 107 is slightly smaller than that of the hole, preferably 3.7 to 4.5 mm. The cross-sectional shape of the rod 107 and the hole 161 does not have to be circular but could be of any suitable shape, e.g. rectangular or triangular.

Furthermore, the locking projection 112 extends radially inwards through the longitudinal slot 124 of the lock core 120 (FIG. 29) to a position being very close to the circumferential surface of the key plug (when the lock core with the key plug is inserted into the casing). In any case, the radial distance between the locking projection 112 and said circumferential surface should not exceed 1 mm. Preferably, the distance is much less. Thus, the radial distance between the locking projection 112 and the rotary axis (coinciding with the centre of the opening 105, FIG. 30) of the key plug 160 should be no more than 1 mm greater than the radial distance between the radially outermost part of the axial rod 107 and the rotary axis.

By the combination of the locking projection 112 and the axial rod 107 extending into the cavity of the casing 100, it will be practically impossible to replace the lock core 120 by another kind of lock core, not even a smaller one. Such a smaller lock core may be narrow enough to be inserted freely passed the projection 112. However, in a smaller lock core, it will be impossible to make a wide enough axial hole in the rear part of the key plug without breaking through the circumferential surface or the central key slot thereof.

Hereby, any unauthorized replacement of the lock core will be hindered effectively.

What is claimed is:

1. Removable core cylinder lock, comprising a cylinder lock casing (10) having interior wall surfaces (13) defining an axially extending cavity (11) with an insertion opening, a removable cylinder lock core (20) which has an outer cross sectional contour corresponding to an inner cross sectional contour of said casing and which is axially insertable into said cavity through said insertion opening, said lock core having an upper, substantially massive part (27) with a row of holes (28) for accommodating locking tumblers (70), and a lower part (21) defining a cylindrical bore extending axially therethrough, a cylindrical, rotatable key plug (60) located in said cylindrical bore and having a longitudinal key slot for receiving a key co-operating with said locking tumblers, and a retainer member (40) being transversely movable in a chamber (30) in the upper part of said lock core between a first position, in which it positively locks said lock core in its axially inserted position, and a second position, in which said lock core may be axially inserted into or retracted from said casing, said retainer member having a locking surface (49) facing towards said insertion opening and engaging with said casing when said retainer member is in said first position, wherein:

said lock casing (10) comprises a locking projection (12), which protrudes from one of said interior wall surfaces (13) so as to project inwardly from said inner cross sectional contour and to engage with said locking surface of said retainer member (40), when the latter is in said first position, and said retainer member (40) is movable circumferentially relative to said cylindrical bore, said lock core being provided with a longitudinal recess which, when said retainer member is located in said second position and said lock core is being inserted into or retracted from said casing, form a longitudinal passage (24) located adjacent to said chamber (30) in the region of said outer cross sectional contour and being dimensioned to accommodate said locking projection that extends into said longitudinal passage.

2. A lock as defined in claim 1, wherein said inner cross sectional contour as well as said outer cross sectional contour are substantially constant along substantially the whole length of said casing and said lock core, except for said locking projection and said longitudinal passage, respectively.

3. A lock as defined in claim 1, wherein said inner cross sectional contour as well as said outer cross sectional contour vary along the axial length of said casing and said lock core, respectively.

4. A lock as defined in claim 1, wherein said longitudinal recess of said lock core (20) is a rectilinear slot (24) formed in said lock core (20), said slot (24) being wider than said locking projection (12), and the retainer member (40) is dimensioned to leave said rectilinear slot (24) at least partially free when being situated in said second position, so as to permit axial displacement of said locking projection (12) along said rectilinear slot (24), during insertion or retraction of said lock core (20), and to effectively block access to said rectilinear slot when being situated in said first position, so as to positively lock said retainer member and said lock core in their axially inserted positions in said cavity of said casing.

5. A lock as defined in claim 4, wherein said retainer member (40) has a limited circumferential extension, which is substantially supplementary to an axially continuous wall portion (21) defining a part of said cylindrical bore (23), and a longitudinal edge portion (51) of said retainer member (40), effectively blocks said rectilinear slot (24) upon being moved into said first position.

6. A lock as defined in claim 5, wherein said locking surface (49) on said retainer member forms an end surface on said longitudinal edge portion (51).

7. A lock as defined in claim 5, wherein said locking surface (49) on said retainer member is located on a transversely projecting, axially limited tongue (51').

8. A lock as defined in claim 5, wherein said locking surface (49) on said retainer member forms a part of an axially limited recess (50) in said longitudinal edge portion (51).

9. A lock as defined in claim 4, wherein said retainer member (40') is circumferentially closed so as to form a circular-cylindrical sleeve element, said lower part of said lock core (20') is divided into two axially separate portions **(20*a*, 20*b*), one of which is provided with said rectilinear slot (24), said retainer sleeve element (40') has an axially extending slot portion (24') constituting a longitudinal recess of the retainer member and being aligned to said rectilinear slot (24) when being located in said second position and being offset from said rectilinear slot when being located in said second position, and said slot portion (24') in said retainer sleeve element (40') communicating circumferentially with an axially limited recess (50")** dimensioned to accommodate said locking projection, said slot portion and said recess forming a bayonet-type locking groove.

10. A lock as defined in claim 1, wherein said locking projection (12) has a radial extension being limited so as not to interfere directly with said rotatable key plug (60).

11. A lock as defined in claim 10, wherein the radial extension of said locking projection (12) is such as to reach into close vicinity to the wall surface of said cylindrical bore (23).

12. A lock as defined in claim 11, wherein said key plug (160) is coupled to a rotatable locking member (104) journalled at the inner end portion of said casing (100) by means of an axial rod (107) secured to said locking member and a corresponding axial hole (161) in the end portion of the key plug, and the radial distance between said locking projection (112) and the circumferential surface of said key plug is less than 1 mm, whereas the smallest wall thickness between said circumferential surface and said axial hole is less than 0.5 mm.

13. A lock as defined in claim 12, wherein the diameter of said cylindrical key plug (160) is 12 to 14 mm, and the width of said axial hole (161) is 4 to 5 mm, and the width of said axial rod (107) is 3.7 to 4.5 mm.

14. A lock as defined in claim 8, wherein said casing (10) has, in addition to said locking projection (12), an axially limited recessed portion (14) in one of said interior wall surfaces, and said locking surface of said retainer member comprises, in addition to said axially limited recess (50), a locking lug (46) fitting into said recessed portion (14) when the retainer member (40) is located in said first position.

15. A lock as defined in claim 14, wherein said locking lug (46) is located in close vicinity to said axially limited recess (50).

16. A lock as defined in claim 5, wherein said retainer member (40) comprises a base portion, which is formed substantially as a part-cylindrical shell with external and internal cylindrical surfaces.

17. A lock as defined in claim 1, wherein said key plug comprises a side bar (62), said side bar being movable between a releasing position within a groove (63) in the cylindrical outer surface of the rotatable key plug (60) and a locking position engaging a longitudinal recess (29) adjoining said cylindrical bore (23) of the lock core (20).

18. A lock as defined in claim 12, wherein the radial distance between said locking projection (112) and a rotary axis in said cavity is at the most 1 mm greater than the radial distance between said rotary axis and the radially outermost part of said axial rod (107).

19. A casing as defined in claim 18, wherein the radial distance between said locking projection (112) and said rotary axis is 6 to 7 mm, whereas the width of said axial rod (107) is 3.7 to 4.5 mm.

20. A removable lock core (20) for use in a lock as defined in claim 1, having an upper, substantially massive part (27) with a row of holes for accommodating locking tumblers (70), a lower part (21) defining a cylindrical bore extending therethrough for accommodating a rotatable key plug, and a retainer member (40) being movable in a chamber (30) in said lock core (20) between a first, locking position, in which it positively locks the lock core in an axially inserted position within an associated casing, and a second, releasing position, in which the lock core may be inserted into or retracted from said casing, the outer cross sectional contour of the lock core corresponding to the inner cross sectional contour of said associated casing, wherein:

said retainer member (40) is movable circumferentially relative to said cylindrical bore, said lock core (20) being provided with a recess which, when said retainer member (40) is located in said second position, form a longitudinal passage (24) located adjacent to said chamber (30) in the region of said outer cross sectional contour and being dimensioned to accommodate a locking projection protruding from an interior wall of said associated casing, radially inwards from said inner cross sectional contour, and said retainer member (40) has a locking surface (49) adapted to engage with said locking projection, when said retainer member (40) is located in said first position.

21. A removable core as defined in claim 20, wherein the rear end portion of said key plug (160) has an axial hole (161) for receiving an axial rod (107) secured to a rotatable locking member (104), and the smallest wall thickness between the circumferential surface of said key plug and said axial hole is less than 0.5 mm.

22. A removable core as defined in claim 21, wherein the width of said axial hole (161) is 4 to 5 mm.

* * * * *